United States Patent [19]

Young

[11] 4,349,188

[45] Sep. 14, 1982

[54] RE-REGISTERING FEEDER AND METHOD OF REGISTERING

[76] Inventor: William G. Young, 79 Atterbury Blvd., Ste. 201C, Hudson, Ohio 44236

[21] Appl. No.: 275,885

[22] Filed: Jun. 22, 1981

Related U.S. Application Data

[63] Continuation-in-part of Ser. No. 30,722, Apr. 18, 1979, abandoned.

[51] Int. Cl.[3] ..... B65H 5/00

[52] U.S. Cl. ..... 271/225; 271/236; 271/250; 271/184

[58] Field of Search ..... 271/225, 227, 228, 236, 271/237, 248, 250, 251, 184, 185

[56] References Cited

U.S. PATENT DOCUMENTS

| | | | |
|---|---|---|---|
| 3,401,930 | 9/1968 | Bishop | 271/225 |
| 4,092,022 | 5/1978 | Preuss | 271/236 |
| 4,203,588 | 5/1980 | Joosten | 271/236 X |

*Primary Examiner*—Richard A. Schacher

*Attorney, Agent, or Firm*—Oldham, Oldham, Hudak & Weber Co.

[57] ABSTRACT

A re-registering feeder machine which is also an improvement to a separating machine accepts sheets of paperboard or other material with various angles of skew, registers them and feeds them to a following machine. A conveyor deck moves the sheet in a first direction where at the last roll the sheet is held down by a plurality of balls in cooperative rotation with the last roll and its leading edge meets a side register guide having a plurality of pairs of tapered drive rolls to grip the sheet along the margin and move the sheet in a second direction at right angles to the first direction after the sheet has been registered. Coatings on the conveyor rolls except for the last roll which has the cooperatively rotating balls in contact therewith provide a proper friction between the rolls and the sheet allowing the sheet to turn in either direction until the angle between its leading edge and the side register guide is zero. The side register guide then operates in coordination with a pair of stops and a force transducer to provide a final registration to a preselected sheet leading edge and corner thereof.

2 Claims, 5 Drawing Figures

RE-REGISTERING FEEDER AND METHOD OF REGISTERING

CROSS-REFERENCE

This application is a continuation-in-part of my earlier application, now abandoned, filed on Apr. 18, 1979 under U.S. Ser. No. 030,722, entitled "Pre-Registering Feeder and Method of Registering."

TECHNICAL FIELD

The present invention is in the technical field of paper and sheet handling apparatus.

BACKGROUND ART

The present invention relates generally to machines used in the graphic arts industry which register a paperboard sheet and feed it to the input of another machine where it may be printed, folded, coated, die cut or separated. The present invention may be made a part of such other machines, or a succession of such other machines, or it may be separate but placed adjacent to such other machine which requires sheets to be registered. More specifically, the present invention relates to a machine which receives sheets of paperboard or other material from another machine of which a die cutter would be one example where the sheets are placed or fall with various angles of skew, moves them to a side register where they are registered and then drives them out of this machine and onto the input device of a following machine. Such a following machine, for example, may be the applicants separating machine disclosed in U.S. Pat. No. 4,000,686.

The prior art includes U.S. Pat. No. 3,807,610 and U.S. Pat. No. 3,670,937, both issued to Arthur R. Mueller Jr., as well as applicants U.S. Pat. No. 4,000,686 referred to above. These patents disclose separating machines wherein die cut cards are separated from the paperboard scrap from which they were cut but also include in their input or feeder end some manner of registering device. V-belt feeders as well as flat belt feeders have been used. Feeders which stop while the sheet falls thereto and start thereafter have appeared in the prior art. All such devices depend on a side register guide on the following machine which moves the sheet slowly towards the guide where it is registered. Sheets from a die cutter fall onto a conveyor and in falling often tend to float down rather than dropping down in perfect position. Consequently, in the prior art, a register guide and feeder required a long section of angled conveyor rolls or belts so that the sheet was not turned too quickly resulting in a folded leading edge. With these angle conveyor rolls there is an angle of skew beyond which a sheet will not register but will move forward and into the separator retaining the angle of skew and resulting in a jam-up which loses valuable time and production. In the prior art, the side guide means of registering the sheet are suitable for specific processes only, i.e., where the material is handled in a continuous process such as taught by Mueller U.S. Pat. No. 3,807,610 and U.S. Pat. No. 3,670,937. When the process requires intermittent motion on the part of the transport means (start, stop, dwell), cycle time becomes critical and the sheet of material must be presented to the transport means with the gripper edge re-registered. Otherwise, the subsequent processing would be too slow to justify further mechanization. For example: A 25"×38" sheet (popular size) with the original side guide edge (25") presented to the transport means would require 52 percent more time in traverse than if the original gripper edge were presented. Further, as a practical matter, sheets of material cut exactly square are not commercially available therefore when registering the side guide edge only, any error in out of squareness will be magnified by the ratio of length to width, resulting in significantly greater error in register of the original leading (gripper) edge. The prior art registering devices cannot re-register the original leading (gripper) edge of the sheet.

The present invention side registers a sheet rapidly and reliably, without folding the leading edge, in a space smaller than that required by the prior art devices. The reduced size of the feeder section of separating and other machines results in a reduced cost in addition to a saving in space. The rapid and reliable side registering of a sheet when skewed at substantial angles in either direction is the result of a unique combination of friction coated parallel driven conveyor rolls, a plurality of balls in rolling contact with a final uncoated driven conveyor roll, a throated fixed side register guide, and a plurality of tapered friction complementary pairs of driven side register forwarding rolls.

The present invention may be used in a complete, integrated carton line placed after the printing press and before a die cutter and a second pre-registering feeder machine placed after the die cutter and before the separating machine.

The present invention may also be used in a Blister Card line with one machine placed after the printing press and before the coating conveyor line, another pre-registering feeder machine placed after the coating line and before the die cutter and a third pre-registering feeder after the die cutter and before the stripping machine.

DISCLOSURE OF INVENTION

The novel pre-registering feeder of this invention is an improvement to separating machines, die cutting machines, printing and other machines where sheets of paperboard, plywood, plastic and other materials must be registered and fed to the input of such other machines. It is, therefore, an object of this invention to provide a machine which can receive a sheet at various angles of skew and quickly and reliably register the sheet and then feed it to the input of another machine which is to perform an operation on the sheet.

It is a further object of the present invention to provide a machine which can register paperboard stocks of various thickness without causing any folding of the leading edge of the stock as it meets a register guide.

It is a further object of the present invention to provide a method of registering stocks of various materials and thicknesses quickly and reliably and feeding them to the input of other machines which are to perform operations thereon.

It is also an object of the present invention to provide an improvement to the applicants Separating Machine and Method of Separating.

It is also an object of the present invention to provide a machine which quickly and reliably registers a sheet of stock and feeds the sheet to the input of another machine where the present invention becomes a part of and an improvement to completely integrated lines for the manufacture of cartons and an improvement to blister card lines.

It is a further object of this invention to provide a registering machine which may be incorporated into a printing press, die cutting machine, coating conveyor, stripper machine, or any such machine which requires that sheets of various stocks be quickly and reliably registered.

A further object of the invention is to provide a re-registration of the gripper edge in an efficient, fast, and very reliable manner based upon the initial registration of the side edge. Conventional registration heretofore has done a front registration followed by a side registration.

These and other objects of the present invention, together with the advantages thereof over existing prior art which will become apparent from the following specification, are achieved in an apparatus comprising a pre-registering feeder for a substantially rectangular sheet which includes in combination: a base, a plurality of parallel conveyor rolls rotatably mounted on said base; a drive means for said parallel conveyor rolls for a movement of a sheet in a first direction; a frame member mounted on said base parallel to and above the last conveyor roll in the first direction of travel; means carried by said frame member in rotational contact with said last conveyor roll for holding down said sheet; a side register guide; a plurality of complementary pairs of drive rolls mounted in conjunction with said side register guide to grip said sheet along the margin of said sheet after a respective edge of the sheet has been registered adjacent thereto and to move said sheet in a second direction at right angles to the first direction while the sheet is continuously actuated in said first direction to hold the respective edge flush along its full length to the register guide; a drive means for said pairs of drive rolls; a pair of alignment stop means arranged in angled cooperative relation to the register guide whereby one of the stop cooperative means is contacted first after some movement of the sheet in the second direction, whereby the sheet pivots about said one stop means toward the other stop means while the respective edge corner of the sheet remains in contact with the register guide; and means to sense when the sheet contacts the other stop means.

BRIEF DESCRIPTION OF DRAWINGS

In the drawings which are illustrative of the preferred embodiment of the invention, by way of example.

BEST MODE FOR CARRYING OUT THE INVENTION

Figure 1:
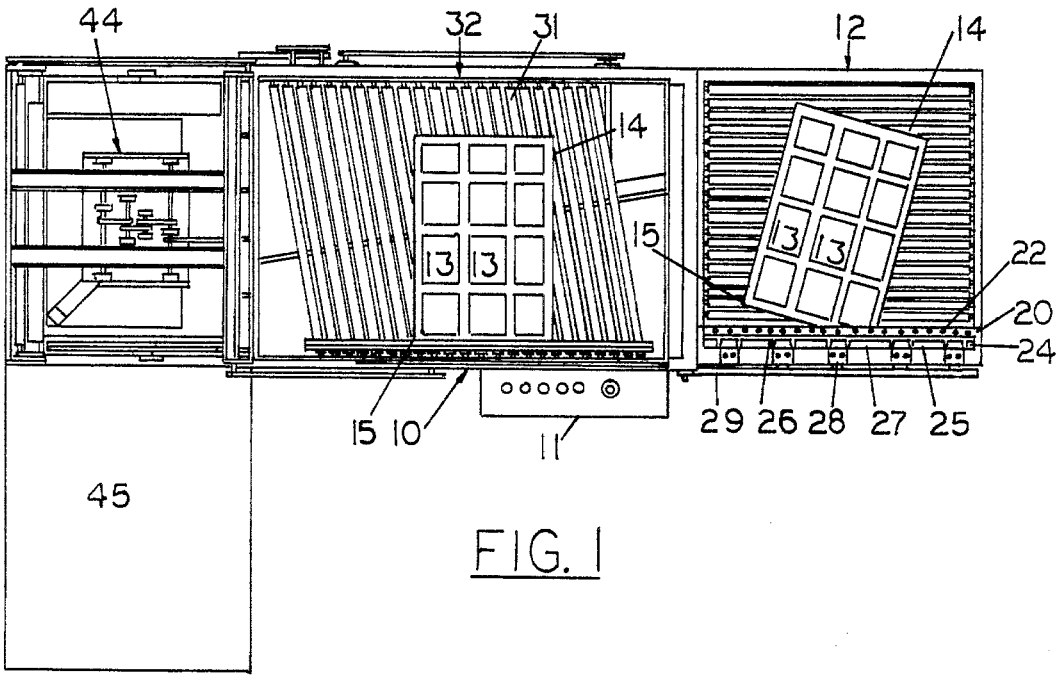
FIG. 1 is a schematic plan view of a separating machine with the present invention of a pre-registering feeder machine shown at the input or feeder end.

Referring now specifically to the drawings, in which identical or similar parts are designated by the same reference numerals throughout, and referring first to FIG. 1, there is shown a card separating machine which is designated generally by the numeral 10 and the present invention, a pre-registering feeder machine, designated by the numeral 12.

Figure 2:
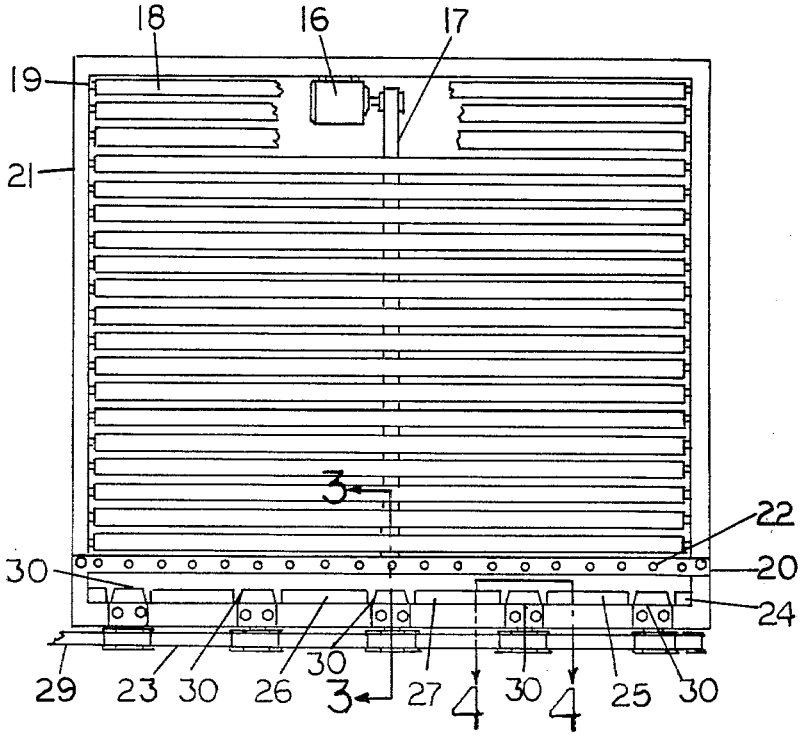
FIG. 2 is a schematic plan view of the pre-registering feeder machine.
Figure 3:
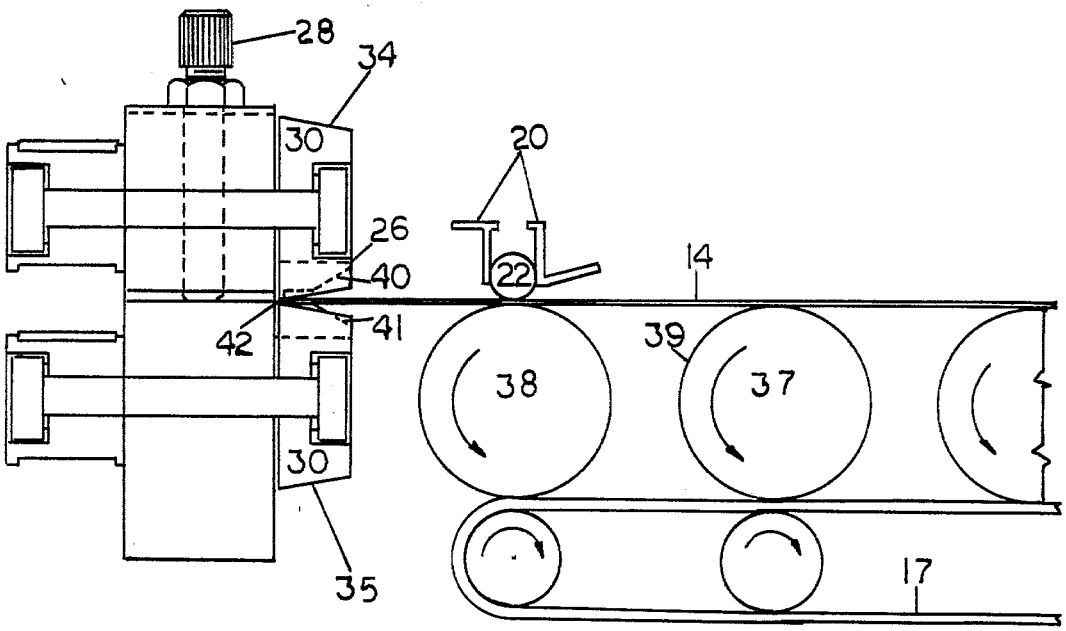
FIG. 3 is a section taken along line 3—3 in FIG. 2 showing the sheet held down by the balls over the last conveyor roll together with the side register guide and the pair of tapered drive rolls.
Figure 4:
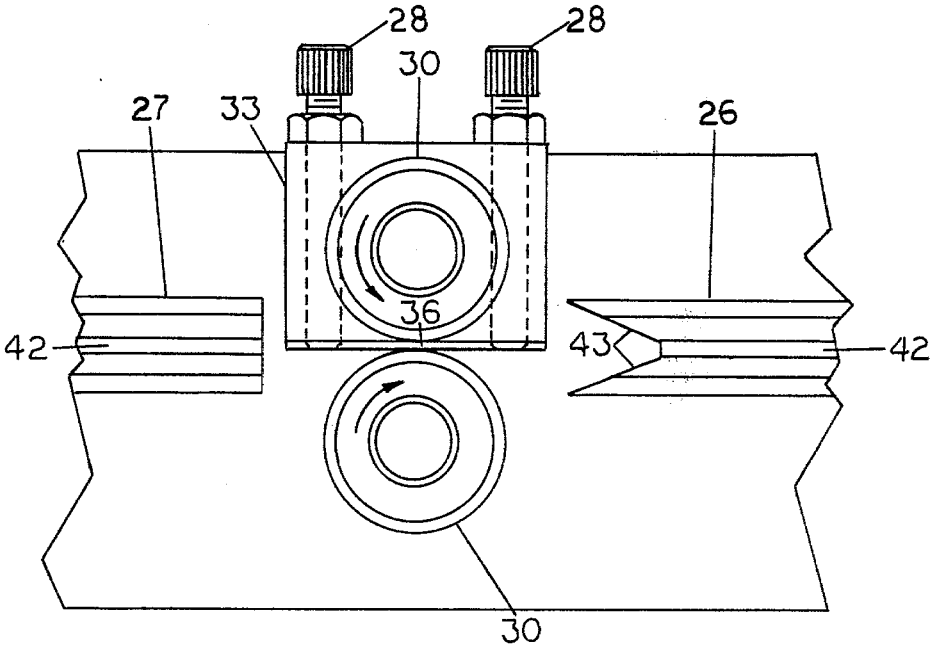
FIG. 4 is a section taken along line 4—4 in FIG. 2 showing the drive rolls and the side register guide.

A paperboard sheet 14 is shown on the conveyor deck at an angle of skew with a portion of the leading edge corner 15 at some distance from the guide surface 24. While the sheet is on the conveyor deck it is propelled in the first direction toward the side guide register 24 with friction contact between the sheet 14 and the conveyor rolls 18. The conveyor rolls shown in FIG. 1 and FIG. 2 are mounted in frame member 21 which serves as a base by bearings or other suitable mounting means 19. When the first portion of the advancing sheet is close to the guide 24, it comes between a plurality of balls 22 which are held in a frame member 20 over the last conveyor roll 38 as shown in FIG. 3. The sheet changes from frictional contact with the conveyor deck to sliding contact when the most forward portion of the rectilinear edge reaches guide 24. If the remainder of the edge is not yet in engagement with the guide center 42, FIG. 3 and FIG. 4, the conveyor deck continues to advance this edge portion until the complete leading edge is registered by being in full engagement with the guide center 42. Complementary pairs of tapered drive rolls 30 are placed at intervals along guide 24 and between guide sections as in FIG. 4 where one pair is shown between guide sections 26 and 27. The contact point 36 between the upper and lower rolls is positioned in alignment with the guide center 42 as shown in FIG. 3. The pairs of drive rolls 30 grip the edge of the sheet 14 and move it in a direction transverse to the first direction only after the leading edge is completely engaged with the guide center 42. If a corner portion of the sheet should come directly between a pair of drive rolls 30 while the forward edge is at an angle with respect to the guide, then this corner portion will move only slightly in the transverse direction after which it is no longer at the drive roll contact point 36. After the conveyor deck has advanced the sheet to full and complete engagement with the guide 24, the leading edge of the sheet will be at the contact point 36 of several pairs of drive rolls and at the same time the sliding friction force from the conveyor rolls 18 holds the sheet in such complete engagement. In this complete engagement, the drive rolls move the sheet 14 in the transverse direction. The movement of sheet 14 in a first direction until the leading edge is registered is accomplished in this best mode by a surface speed on the conveyor deck which is approximately 20 percent greater than the speed which the complementary pairs of drive rolls 30 impart to the sheet in moving the sheet in a transverse direction. The deck conveyor rolls 18 tangential velocity will always be greater than the speed in the transverse direction, however, the percentage will be a function of the various frictional forces of the conveyor rolls 18 on the deck, the final roll 38 with balls 22 and the pairs of drive rolls 30. These two velocities examined as a vector sum result in a force on the sheet 14 which continues to propel the sheet toward the guide 24 until the leading edge is in complete engagement with the guide center 42. At this point, when the sheet 14 cannot move further in the first direction because it is completely registered, the vector force caused by the pairs of drive rolls 30 becomes the dominant force and the sheet 14 advances in the transverse direction, maintaining full contact with the guide center 42 as it is fed out of the pre-registering feeder machine. A drive belt 17 turned by a motor 16 is shown in FIG. 2 and FIG. 3 as the drive means for the conveyor deck. In other arrangements shafts and gear boxes from the following machine, for example the separating machine shown in FIG. 1, provide the drive means for the conveyor deck. In the illustrated best mode, the control for the pre-registering feeder 12 is contained within the control panel 11 on the separating machine. In FIG. 3 and FIG. 4, jack screws 28 provide vertical adjustment of the frame member 33 holding the upper tapered drive roll. A downward pressure is exerted on the upper tapered drive roll by the timing belt drive means 23. This combination of jack screws 28 and timing belt 23 provides a positive downward pressure on the upper drive roll such that the proper drive of the sheet 14 in the transverse direction is obtained over a range of sheet thicknesses. The drive means for the timing belt 23 is indicated in FIG. 1 and FIG. 2 to be taken from the separating machine 10, with the cut-off end of the timing belt 23 shown by numeral 29. In other embodiments, the drive means for this timing belt 23 is taken from gear box and shaft arrangements coupled to the conveyor deck drive motor 16 and belt 17 in order that the relative velocities of the conveyor rolls 18 and the complementary pairs of drive rolls 30 will have the proper ratio. In FIG. 3 the tapered surface 34 of the upper drive roll and the tapered surface of the lower drive roll 35 are shown. These two surfaces are in rotational contact, one with the other, at contact point 36. Sheet 14 is illustrated in FIG. 3 with an edge between the tapered drive rolls. If this portion of sheet 14 is only the leading edge corner then the drive rolls 30 will move it only a short distance after which the corner is not between the tapered surfaces 34 and 35. Only after the sheet 14 is registered will each of the plurality of complementary pairs of tapered drive rolls 30 grip the leading edge moving it at right angles to the first direction but maintaining contact with the leading edge as it drives out of the pre-registering feeder. The sheet 14, therefore, does not drive out of the pre-registering feeder until the sheet is registered. This registering is accomplished by the conveyor drive rolls, the last two of which, 37 and 38, are shown in FIG. 3 turning in the direction shown, therein the conveyor roll surface 39 is a friction surface particularly adjusted to move the sheet 14 in the first direction toward the side register guide section 24 without causing the sheet 14 to buckle or fold at the guide. This friction surface 39 is adjusted to the friction between the balls 22 and the last conveyor roll 38 in the first direction of travel as well as the friction between the complementary pairs of drive rolls 30. When the drive rolls 30 move the sheet 14 out of the pre-registering feeder 12, the sheet 14 is sliding along the conveyor rolls 37 and 38, in a direction parallel to the rolls while the rolls continue to turn in the direction shown in FIG. 3. The sheet 14 is held down as shown by the balls 22 which are free to rotate in a first direction as the sheet moves toward the side register guide 24 and then in a second direction as the sheet is moved out of the pre-registering feeder 12 by the complementary pairs of tapered drive rolls 30. The side register guide section 26 shown in phantom in FIG. 3 has upper angled surface 40 and lower angled surface 41 to direct the sheet 14 to the center 42 of the side register guide where the contact point 36 of the upper and lower drive rolls can grip the leading edge of the sheet. In FIG. 4, the side register guide section 26 is shown on the first side of the drive rolls 30 and the guide section 26 is on the opposite side so that the sheet 14 would be moving in a direction from the guide section 27 to the guide section 26 as it moves out the pre-registering feeder 12. The input end of guide section 26 contains a throat 42 formed by angles on the upper and lower surfaces of the guide section to receive and adjust the leading edge of sheet 14 in the event that the sheet has a slight turn-up or turn-down corner.

Hence, the unique characteristics of the feeder machine 12 are in the following:

1. The squared or perpendicular relation of the drive rolls 30 to the guide surface 24 ensures a linear and parallel movement of the sheet to the surface 24.

2. The open top configuration to the machine 12 allows any sheet orientation to simply drop onto the top surface, thus giving the machine great versatility.

3. The speed differential between rolls 30 and rolls 18 ensures that the sheet 14, once oriented with surface 24, will stay oriented during movement away to the next operation.

In some situations, it is not compatible that the registration of the sheet 14 on only a single side will make the sheet properly oriented and registered for a subsequent operation. Particularly because of progressing speed requirements, the longer (gripper) edge and corner (side guide) must be registered for subsequent machine operations. Hence, in these instances, further registration is needed. A simplified structural arrangement to obtain such further registration is described hereinafter, particularly with reference to FIG. 5 of the drawings.

First, it should be understood that the subsequent registration is achieved to orient around the leading edge corner 15 on the skew sheet 14, shown in FIG. 1 of the drawings, and wherein the respective edges adjacent to the leading edge corner 15 are identified as a left or registration edge **15*a* and the right or gripper edge 15*b*, also as seen in FIG. 1 of the drawings. The additional registration described with respect to FIG. 5 deals with registering the leading edge corner 15 and right edge 15*b* for use in a subsequent operation on the sheet 14**.

This is achieved by providing a short follow-on section 60 mounted at the same level and in the same plane as the sheet carrying level of the registering feeder machine 12. Mounted at spaced intervals onto the surface 60 are a pair of stops 62 and 64, which register the leading (gripper) edge of the sheet. A sensing means 74 cooperates with stop 62 which sends a signal to an impact sensing activator. In effect, the activator 68 generates the signal indicating full proper registration of the sheet 14 for action thereon by the next station. In this instance it is depicted as sending a signal over line 70 to a pair of clamp arms 72 which will clamp over the edge **15*b* of sheet 14** and effectively advance the sheet for the action at the subsequent station.

Figure 5:
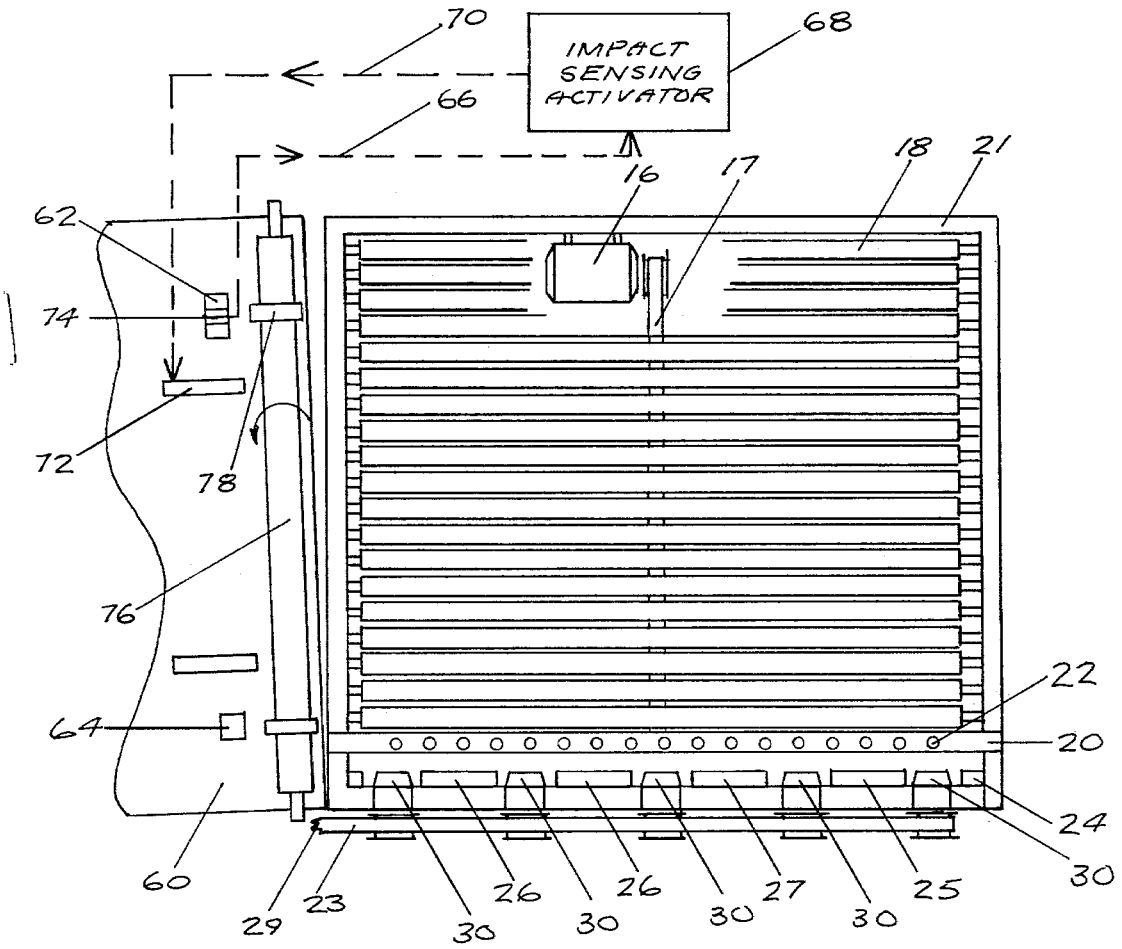
FIG. 5 is a schematic plan view of a modification to the basic pre-registering feeder machine shown in FIG. 2.

It should be noted that the stops 62 and 64 are mounted at a slightly angular offset relationship from the guide 24, which is well shown in FIG. 5 where the stop 64 is positioned closer to the frame member 20 than the stop 62. Hence, in effect, a line connecting the front edges of stops 62 and 64 is not perpendicular to the guide register 24, but will be a few degrees off the perpendicular. This intentional angular offset of the stops 62 and 64 means that the edge **15*b* will impact upon stop 64 first in every instance as the sheet 14 moves with edge 15*a* in aligned contact with guide register 24. When the edge 15*b* contacts stop 64, and with the continued movement of sheet 14 caused by the combined effect of the drive roll 30 and the conveyor rolls 18, it will ensure that the leading edge corner 15 remains right up against the guide register 24 and stop 64. However, because the positioning of stop 62 is somewhat angularly displaced as explained above, nip roll 78 cooperates with forwarding roll 76 to advance edge 15***b* into contact with stop 62 and transducer 74 to achieve the final registration. Hence, it should be understood that the final registration has edge 15*b* perfectly aligned with these stops 62 and 64, and leading edge corner 15 immediately adjacent the guide register 24. In this way, it is ensured that the sheet 14 is in perfect alignment in two dimensions, rather than the single dimension possible with the embodiment described above in connection with FIGS. 1 through 4.

Thus, it should be understood that the initial aligning mechanism of FIGS. 1 through 4 will properly orient a sheet 14 regardless of its initial received position so as to provide leading edge corner 15 at a precise position with respect to stop 64 and transducer 74, and also create a pivoting action to sequentially and very accurately align edge 15*b* between both the stops 62 and 64.

The circuitry of the activator 68 will be set up in a manner well known to one skilled in the art so that as soon as stop 62 indicates an impact, it will clearly know that full alignment and registration for the subsequent operation is achieved and send an actuation signal over line 70 to any desired function, which is typically indicated in FIG. 5 as the gripping fingers 72, a well known way in the art to achieve the operable working grasp of the sheet once proper registration has been achieved.

There, in summary, the invention can be utilized to achieve a single side guide registration of the sheet in the manner shown in FIGS. 1 through 4 or can achieve a single side guide and leading gripper edge corner registration utilizing the simple modification of FIG. 5. The key to the FIG. 5 modification is the angular displacement of the stops 62 and 64 from the normal movement direction along the guide register 24 so that final sensing of registration is always achieved by stop 62 and sensing means 74. In effect, stop 64 merely holds the sheet with the leading edge corner 15 in contact with the side guide register 24 while the sheet pivots in the counterclockwise direction for the gripper edge 15*b* to stop 62 and sensing means 74. It is thus when sensing 74 notices the impact or contact of the edge 15*b* that the registration is totally completed.

It should be understood that the section 60 and its associated components can be an integral part of the next processing station, or an integral part of the registering feeder machine 12, or a separate component attaches between the machine 12 and the subsequent equipment.

The pre-registering feeder machine illustrated and described in detail in this specification, in accordance with the patent statutes is the preferred embodiment. It is understood that the invention is not limited thereto, since it will be appreciated that a number of modifications, variations and other alternatives are possible. Accordingly, the invention should be considered to include all variations and alterations falling within the scope of the appended claims.

What is claimed is:

1. In an apparatus comprising a pre-registering feeder for a substantially rectangular sheet which includes in combination:

a base;

a plurality of parallel conveyor rolls rotatably mounted on said base;

a drive means for said parallel conveyor rolls for a movement of a sheet in a first direction;

a frame member mounted on said base parallel to and above the last conveyor roll in the first direction of travel;

means carried by said frame member in rotational contact with said last conveyor roll for holding down said sheet;

a side register guide;

a plurality of complementary pairs of drive rolls mounted in conjunction with said side register guide to grip said sheet along the margin of said sheet after a respective edge of the sheet has been registered adjacent thereto and to move said sheet in a second direction at right angles to the first direction, while the sheet is continuously actuated in said first direction to hold the respective edge flush along its full length to the register guide;

a drive means for said pairs of drive rolls;

a pair of alignment stop means arranged in angled cooperative relation to the side register guide whereby one of the stop means is contacted first after some movement of the sheet in the second direction, whereby the sheet pivots about said one stop means toward the other stop means while the respective gripper edge corner of the sheet remains in contact with the register guide; and means to sense when the sheet contacts the other stop means.

2. A method for registering and feeding sheets comprising the steps of:

receiving the sheet upon a horizontally disposed surface, propelling the sheet in a first direction until a portion of the forward edge is halted by contact with a side guide register, changing from frictional engagement with the forward edge portion to sliding engagement, propelling the remainder of the forward edge in the event that the remainder of the edge is out of engagement with side guide register, gripping the forward edge at a plurality of locations after the entire forward edge is in engagement with side register, feeding the sheet in a second direction at right angles to the first direction, stopping the sheet after some movement in the second direction, while maintaining the forward edge corner in engagement with the side register pivoting the sheet in its plane about such forward edge corner to move the remaining portion of the forward edge slightly away from the side register; and sensing when the sheet has moved a predetermined distance on the pivot to thus register the adjacent sheet edge and the forward edge corner.

* * * * *